US005456181A

United States Patent [19]

Theurer et al.

[11] Patent Number: 5,456,181

[45] Date of Patent: Oct. 10, 1995

[54] MACHINE FOR ASPIRATING BALLAST FROM A BALLAST BED

[75] Inventors: Josef Theurer, Vienna; Herbert Wörgötter, Gallneukirchen; Friedrich Oellerer, Linz, all of Austria

[73] Assignee: Franz Plasser Bahnbaumaschinen-Industriegesellschaft m.b.H., Vienna, Austria

[21] Appl. No.: 184,291

[22] Filed: Jan. 21, 1994

[30] Foreign Application Priority Data

Jan. 29, 1993 [AT] Austria ..... 152/93

[51] Int. Cl.[6] ..... E01B 27/10

[52] U.S. Cl. ..... 104/2; 171/16; 37/104; 15/300.1

[58] Field of Search ..... 104/2, 7.2, 12; 171/16; 37/104; 15/300.1, 345, 346

[56] References Cited

U.S. PATENT DOCUMENTS 4,355,687 10/1982 Theurer et al. ..... 171/16
4,660,248 4/1987 Young ..... 15/346 X
4,938,239 7/1990 Theurer et al. .
5,172,636 12/1992 Theurer et al. ..... 104/2

FOREIGN PATENT DOCUMENTS 2226612 1/1973 Germany .
2172326 9/1986 United Kingdom .

*Primary Examiner*—Robert J. Oberleitner
*Assistant Examiner*—S. Joseph Morano
*Attorney, Agent, or Firm*—Collard & Roe

[57] ABSTRACT

A mobile machine for aspirating ballast from a ballast bed comprises a machine frame extending in a longitudinal direction and supported by undercarriages running on a track. Mounted on the machine frame are a ballast aspirating device comprising a short suction inlet pipe defining a suction inlet port, and a ballast excavating device vertically adjustable by drive means linking the ballast excavating device to the machine frame. The ballast excavating device comprises a substantially horizontally extending beam having opposite ends, a guide roller mounted on each beam end and an endless ballast excavating chain trained over the guide rollers, the beam being pivotal about a vertical axis at one of the beam ends and arranged in an operating position laterally adjacent one of the tie ends at one of the ballast bed shoulders and the suction inlet port being vertically adjustable in said operating position.

13 Claims, 2 Drawing Sheets

MACHINE FOR ASPIRATING BALLAST FROM A BALLAST BED

BACKGROUND OF THE INVENTION

1. Field of the Invention

The present invention relates to a mobile machine for aspirating ballast from a ballast bed supporting a track consisting of rails fastened to ties having opposite ends at shoulders of the ballast bed, which comprises a machine frame extending in a longitudinal direction and supported by undercarriages running on the track, and mounted on the machine frame a ballast aspirating device comprising a short suction inlet pipe defining a suction inlet port, and a ballast excavating device vertically adjustable by drive means linking the ballast excavating device to the machine frame, the ballast excavating device being pivotal about a vertical axis in an operating position for transporting the excavated ballast to the suction inlet port.

2. Description of the Prior Art

British patent No. 2,172,326 discloses such a machine, which comprises a screening installation for cleaning the aspirated ballast removed from the ballast bed. The aspirating device comprises three suction inlet pipes arranged on the machine frame and connected to a compressor by suction hoses. The machine frame is a trailer supported by its own undercarriage on the track and is displaceable relative to a continuously advancing chassis, and the three suction inlet pipes are arranged adjacent each other in a transverse direction so that they may engage the ballast in the same crib in an operating position adjacent a tie. They are vertically and transversely adjustable. A unit for loosening the ballast and to convey it to the suction opening is connected to the lower end of each suction inlet pipe, for which purpose the ballast loosening units are equipped with raking tines and rotatable scraping wheels which are affixed to the end of a horizontal, elongated housing, and the housing is rotatable about a vertical axis. In operation, the ballast loosening units are oriented parallel to the ties, are lowered into a crib to a level below the ties and then rotated in a horizontal plane 90°. In this way, the units engage the ballast below the ties while they are displaced in the crib in the longitudinal direction of the ties. The loosened ballast is aspirated through the suction openings and is either conveyed to the screening installation for cleaning and then redistributed to the ballast bed, or it is entirely removed by a conveyor arranged below the air lock if it is desired to lower the track level. The guidance and drives for the ballast loosening units involve complex structures wherefore the operating efficiency and speed of the machine are relatively low even though the machine advances continuously along the track.

The mobile machine for excavating a ballast bed disclosed in published German patent application No. 2,226,612 comprises a ballast excavating device arranged at each side of the machine frame, each ballast excavating device comprising a beam on which a revolving endless excavating chain is mounted. The beams are vertically adjustable and pivotal about an axis at one of their ends. In a rest position, they are pivotal upwardly about a horizontal axis extending transversely to the machine frame. In operation, the ballast excavating devices are lowered into the ballast on the track shoulders and are then pivoted from both shoulders into the ballast bed under the track. The revolving excavating chains convey the excavated ballast towards the shoulders whence an upwardly inclined conveyor arrangement moves the ballast to a screening installation for cleaning.

U.S. Pat. No. 4,938,239 discloses a suction arrangement for cleaning a track bed, which comprises a suction head having an inlet port, a suction conduit connecting a ventilator to the suction head to create suction at the inlet port and a receptacle incorporating a filter connected to the suction conduit. A compressed air generating arrangement is associated with the suction head and forms a closed pressure-suction system therewith, this arrangement comprising a compressed air discharge nozzle arranged within the inlet port and a compressed air conduit connecting the nozzle to a compressor.

SUMMARY OF THE INVENTION

It is the primary object of this invention to improve a mobile ballast aspirating machine of the first-described type by simplifying its structure while at the same time substantially increasing its operating efficiency.

In a mobile machine for aspirating ballast from a ballast bed supporting a track consisting of rails fastened to ties having opposite ends at shoulders of the ballast bed, which comprises a machine frame extending in a longitudinal direction and supported by undercarriages running on the track, the above and other objects are accomplished according to the invention by mounting on the machine frame a ballast aspirating device comprising a short suction inlet pipe defining a suction inlet port, and a ballast excavating device vertically adjustable by drive means linking the ballast excavating device to the machine frame, which ballast excavating device comprises a substantially horizontally extending beam having opposite ends, a guide roller mounted on each beam end and an endless ballast excavating chain trained over the guide rollers, the beam being pivotal about a vertical axis at one of the beam ends and the vertical axis being arranged in an operating position laterally adjacent one of the tie ends at one of the ballast bed shoulders and the suction inlet port being vertically adjustable.

The combination of this type of a ballast excavating device with the ballast aspirating device has the advantage that the machine operation may be initiated rapidly while the aspirated ballast is removed with simple means. This makes the use of another endless excavating chain unnecessary to remove the excavated ballast from the shoulders. Because the suction inlet pipe is arranged adjacent the tie ends at the track shoulders, the machine may be readily used in track sections where there is little space between the tie ends and an adjacent structure, such as a railroad platform. In addition, locating the suction inlet port at the end of the ties makes a continuous and efficient operation possible.

The suction inlet port is preferably arranged in the operating position close to the guided roller at the ballast bed shoulder. This is an optimal location for the inlet port because the ballast conveyed to the inlet port at the shoulder by the excavating device can be more rapidly aspirated by utilizing the movement imparted to the ballast by the excavating device. The suction inlet port may be placed either at the beam end at which the pivoting axis is located or at the opposite tie end.

A beam having a minimum length of 2.60 meters and a maximum length of 3.25 meters is particularly useful in track sections where there is little space between one tie end and an adjoining structure. With such a beam length, the entire ballast bed may be removed by arranging the suction inlet pipe at the opposite tie end.

According to a preferred embodiment, the mobile ballast aspirating machine further comprises a carrier frame vertically spaced from the beam and extending transversely relative to the longitudinal direction of the machine frame and a vertical carrier affixing the one beam end to the carrier frame. The mobile carrier frame may be an elongated beam extending in a longitudinal direction transverse to the longitudinal direction of the machine frame, a transverse guide is affixed to the machine frame, the elongated beam being displaceably mounted on the transverse guide for displacement in the transverse direction, and a longitudinal displacement drive is connected to the elongated beam. A vertical guide post carries the transverse guide, a vertical guide in the machine frame receives and guides the vertical guide post, and a vertical adjustment drive is connected to the vertical guide post for vertically adjusting the transverse guide relative to the machine frame. Such an arrangement enables the excavating beam to be oriented in its operating position below the track without any problems and, at the same time, to move it simply into a rest position within the machine when the machine is moved from one operating site to another.

A pivot shaft preferably supports the transverse guide on the vertical guide post, the pivot shaft extending in the longitudinal direction of the machine frame and perpendicularly to the longitudinal direction of the elongated beam, and a tilting drive is provided for tilting the transverse guide about the pivot shaft in a plane extending vertically relative to the longitudinal direction of the machine frame. This enables the excavating beam to be very simply tilted into an oblique position relative to the horizontal track plane so that the surface of the subgrade may be obliquely inclined after the ballast bed has been removed, which assures an optimal removal of any standing water from the subgrade.

According to another preferred feature, the mobile ballast aspirating machine further comprises a vertical baffle plate extending perpendicularly to the longitudinal direction of the beam, the suction inlet port being arranged between the baffle plate and the one tie end. This assures a complete aspiration of the ballast under various operating conditions so that all the ballast is removed.

According to a particularly preferred embodiment, the mobile ballast aspirating machine comprises two such ballast excavating devices spaced from each other in the longitudinal direction of the machine frame, the one pivotal beam ends of the ballast excavating devices being arranged opposite each other with respect to a vertical plane of symmetry extending in the longitudinal direction of the machine frame. Such a machine will have a very high operating efficiency if the two excavating devices are operated at different excavating levels so that the ballast bed is removed in two layers. At the same time, this machine can also be operated with a single ballast excavating device if obstacles on one side of the track make the immersion of the excavating device at that one track side impossible.

The ballast will be very effectively aspirated, separated from the suction air in a simple manner and taken away with an aspirating device which comprises a compressor connected to the short suction inlet pipe, a cyclone separator arranged between the inlet pipe and the compressor, and an air lock at an outlet of the cyclone separator, and if a conveyor is arranged below the air lock of the cyclone separator for receiving and removing the ballast from the separator, with a transfer conveyor arranged on the machine frame for receiving the conveyed ballast from the conveyor and projecting beyond an end of the machine frame.

If an air filter is arranged between the cyclone separator and the compressor for filtering dust from the suction air, and a worm conveyor is arranged to receive the filtered dust from the air filter and to discharge the dust on the conveyor arranged below the air lock, the dust which is unavoidably aspirated by the ballast will be removed with the ballast and the ambient atmosphere will be dust-free.

The mobile ballast aspirating machine can be used for a complete track rehabilitation if it comprises an operator's cab mounted on the machine frame within view of the ballast excavating device, a track lifting device and a ballast tamping unit mounted on the machine frame rearwardly of the ballast excavating device in an operating direction of the machine, and a device for discharging ballast mounted on the machine frame between the track lifting device and the ballast excavating device.

BRIEF DESCRIPTION OF THE DRAWING

The above and other objects, advantages and features of the present invention will become more apparent from the following detailed description of a now preferred embodiment thereof, taken in conjunction with the accompanying, partly schematic drawing wherein.

DETAILED DESCRIPTION OF THE PREFERRED EMBODIMENT

Figure 1:
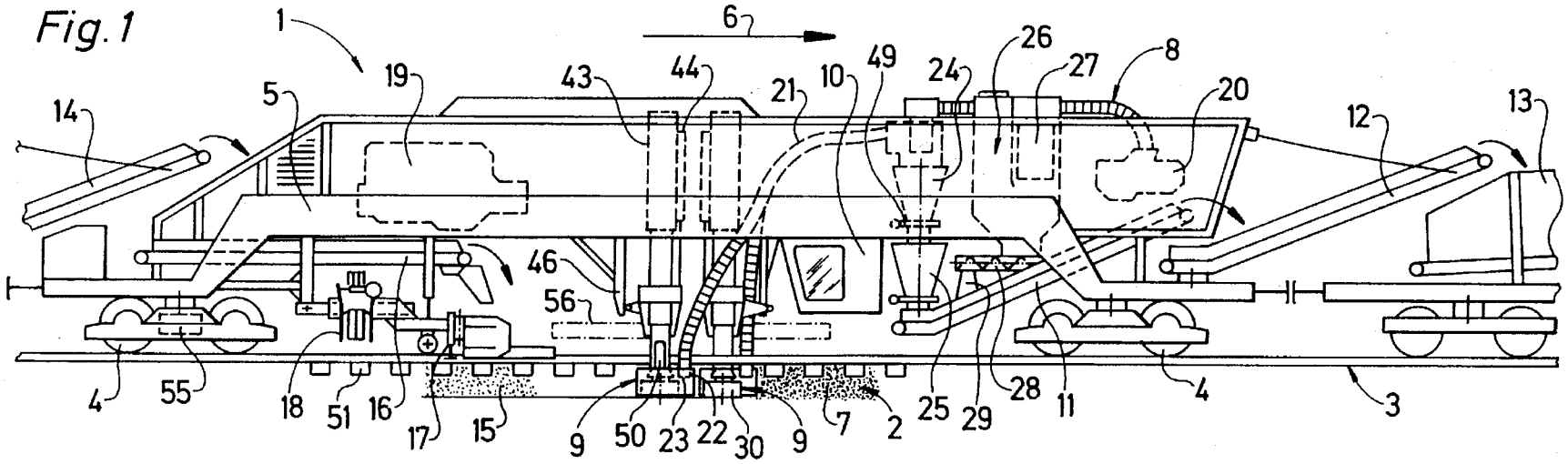
FIG. 1 is a side elevational view of a mobile machine for aspirating ballast from a ballast bed according to this invention.
Figure 2:
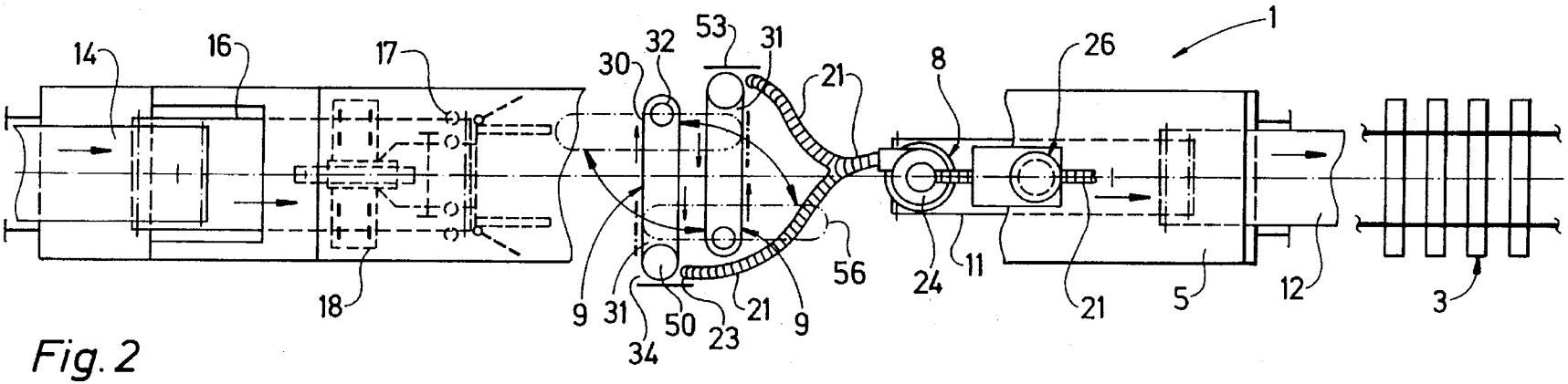
FIG. 2 is a simplified diagrammatic top view of the machine of FIG. 1, with the machine frame broken away to illustrate the ballast excavating and aspirating devices.

Referring now to the drawing and particularly to FIGS. 1 and 2, there is shown mobile machine 1 for aspirating ballast 7 from a ballast bed supporting track 3 consisting of rails fastened to ties 51 having opposite ends at shoulders of the ballast bed. Machine 1 comprises elongated, bridge-like machine frame 5 extending in a longitudinal direction and supported at its opposite ends by undercarriages 4, 4 running on track 3 for movement of the machine in an operating direction indicated by arrow 6. Ballast aspirating device 8 and ballast excavating device 9 are mounted on machine frame 5. The ballast aspirating device comprises short suction inlet pipe 22 defining suction inlet port 23, and the ballast excavating device is vertically adjustable by drive means 44 linking the ballast excavating device to the machine frame. The ballast excavating device comprises substantially horizontally extending beam 31 having opposite ends, guide roller 32 mounted on each beam end and endless ballast excavating chain 30 trained over guide rollers 32. The beam is pivotal about vertical axis 37 (see FIG. 4) at one of the beam ends and vertical axis 37 is arranged in an operating position laterally adjacent one of the tie ends 34 at one of the ballast bed shoulders, and suction inlet port 23 is vertically adjustable. Drive 50 for revolving endless excavating chain 30 is mounted on the one beam end.

In the preferred embodiment illustrated herein, mobile ballast aspirating machine 1 comprises two ballast excavating devices 9 spaced from each other in the longitudinal direction of machine frame 5. The one pivotal beam ends of the ballast excavating devices are arranged opposite each other with respect to a vertical plane of symmetry extending in the longitudinal direction of the machine frame, as shown in FIG. 2.

The illustrated mobile ballast aspirating machine comprises an operator's cab 10 mounted on machine frame 5 within view of ballast excavating device 9, a track lifting device 17 and a ballast tamping unit 18 mounted on the machine frame rearwardly of the ballast excavating device in an operating direction of the machine, and a device 16 for discharging ballast mounted on the machine frame between track lifting device 17 and ballast excavating device 9. Transfer conveyor 14 conveys new ballast 15 from a silo car coupled to machine 1 at a rear end thereof to ballast discharging device 16 for supplying new ballast, and the new ballast is tamped by tamping unit 18 while the track is held at a desired level by track lifting device 17. This arrangement has been described in detail and is claimed in our simultaneously filed application entitled "Machine for Rehabilitating a Ballast Bed".

The aspirated ballast is removed from the machine by conveyor 11 mounted below aspirating device 8 for receiving the ballast and conveying it to a transfer conveyor 12 projecting beyond a front end of machine frame 5. The transfer conveyor is transversely pivotal so that it may discharge the conveyed ballast at either shoulder or into a silo car 13 coupled to the front end of machine frame 5. A central power plant 19 is mounted on the machine frame for supplying power to all the operating drives of the machine, as well as to machine drive 55.

Figure 4:
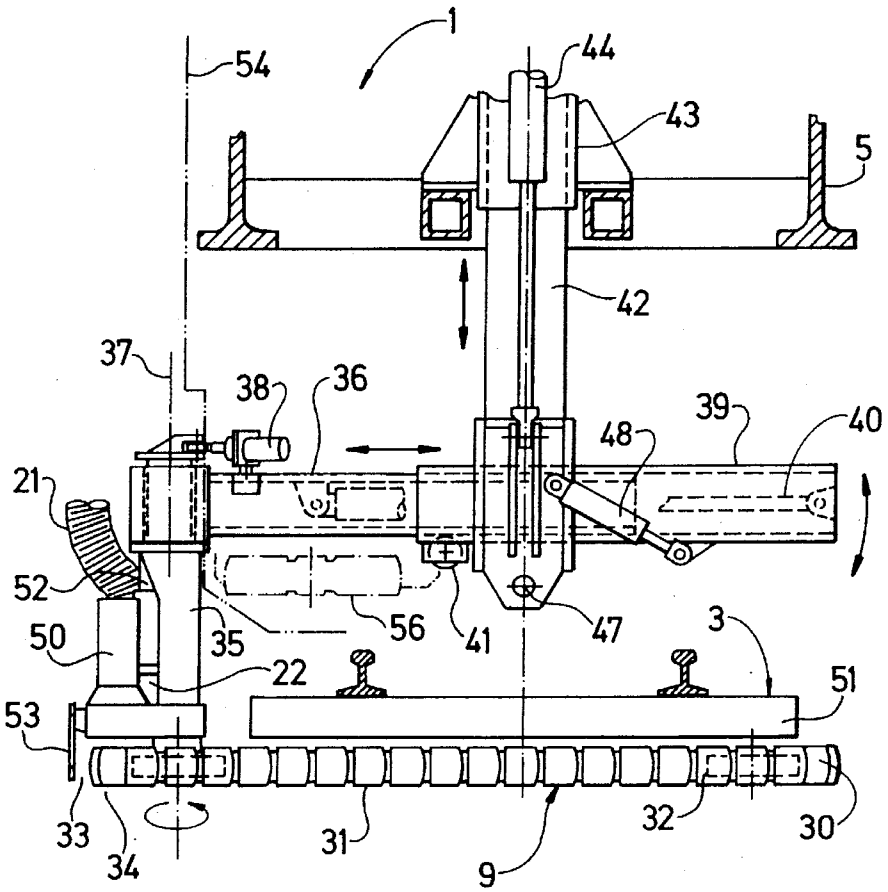
FIG. 4 is an end view taken in the direction of arrow IV in FIG. 3.
Figure 3:
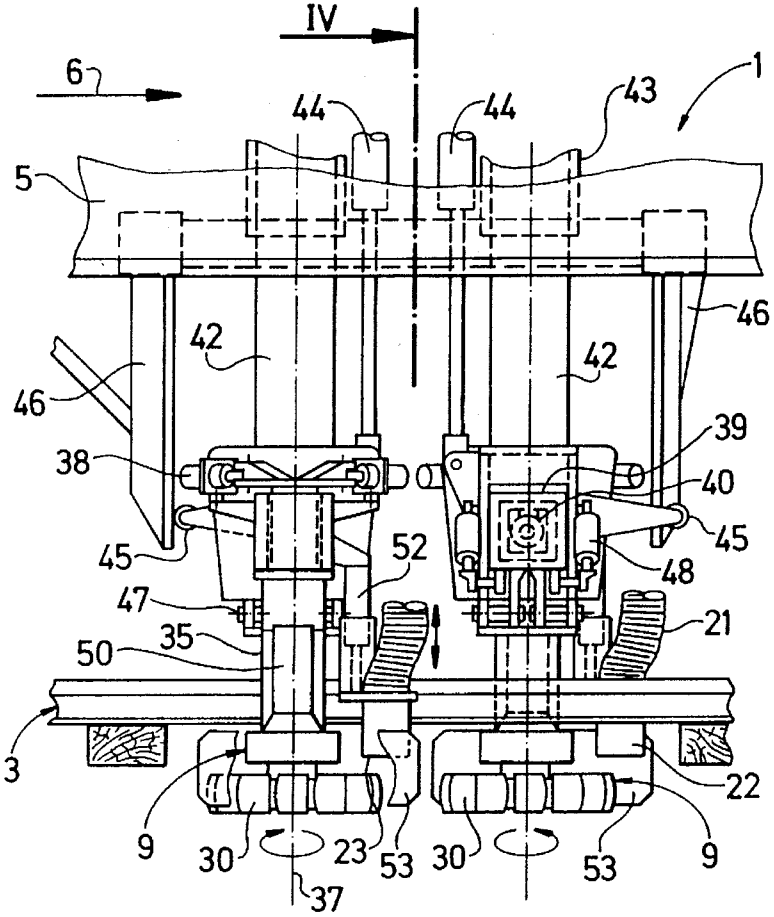
FIG. 3 is an enlarged fragmentary side elevation view showing the ballast excavating devices in greater detail.

As best shown in FIGS. 3 and 4, suction inlet port 23 is arranged in the operating position close to the guided roller at the ballast bed shoulder. The preferred minimum length of the beam is 2.60 meters and the maximum length is preferably 3.25 meters. A carrier frame 36 is vertically spaced from beam 31 and extends transversely relative to the longitudinal direction of machine frame 5 and vertical carrier 35 affixes the one beam end to carrier frame 36. The vertical carrier is rotatably mounted on carrier frame 36 and thus constitutes vertical pivoting axis 37 about which excavating beam 31 may be pivoted in a horizontal plane by pivoting drive 38 which links the vertical carrier to the carrier frame.

Carrier frame 36 is an elongated beam extending in a longitudinal direction transverse to the longitudinal direction of machine frame 5, and a hollow transverse guide 39 is affixed to the machine frame, the elongated carrier frame beam 36 being displaceably mounted in transverse guide 39 for displacement in said transverse direction. Longitudinal displacement drive 40 is connected to the elongated carrier frame beam. Vertical guide post 42 carries transverse guide 39 at a lower end thereof and vertical guide 43 in machine frame 3 receives and guides the vertical guide post, and a vertical adjustment drive 44 is connected to vertical guide post 42 for vertically adjusting transverse guide 39 relative to machine frame 5. As shown in FIG. 3, for additional support relative to machine frame 5 in the longitudinal direction, transverse guide 39 is equipped with support roller 45 engaging vertical support rail 46 affixed to the machine frame for supporting the transverse guide during its vertical adjustment. Pivot shaft 47 supports transverse guide 39 on vertical guide post 42, the pivot shaft extending in the longitudinal direction of machine frame 5 and perpendicularly to the longitudinal direction of elongated carrier frame beam 36. Tilting drive 48 links the vertical guide post to transverse guide 39 for tilting the transverse guide about the pivot shaft in a plane extending vertically relative to the longitudinal direction of the machine frame. With this arrangement, the ballast excavating device is universally movable into a variety of operative and non-operative positions. In addition, a vertical baffle plate 53 extends perpendicularly to the longitudinal direction of beam 31, suction inlet port 23 being arranged between baffle plate 53 and the one tie end. The baffle plate is connected to vertical carrier 35, in the operating position of ballast excavating device 9, and extends parallel to the longitudinal direction of machine frame 5. It cooperates with excavating chain 30 to accumulate the ballast in area 33 below suction inlet port 23 so that all the ballast may be readily aspirated through the port.

The ballast aspirating device 8 comprises compressor 20 connected to short suction inlet pipe 22, cyclone separator 24 arranged between the inlet pipe and the compressor, and air lock 25 at an outlet of the cyclone separator. Suction hose 21 is bifurcated above ballast excavating device 9 and connects compressor 20 to the two suction inlet pipes provided in the preferred embodiment illustrated herein. Ballast 7 aspirated through suction ports 23 is sucked into cyclone separator 24 by compressor 20 through suction hose 21 and is separated from the tangentially introduced suction air in the separator by centrifugal force in a known manner. The separated ballast drops to the lower outlet end of separator 24, which is air-tightly closed by closure 49. A like cyclone separator 25 underneath the outlet end of separator 24 forms an air lock through which ballast 7 is moved to conveyor 11 arranged below air lock 25 of cyclone separator 24, which receives and removes the ballast from the separator. Transfer conveyor 12 is arranged on machine frame 5 for receiving the conveyed ballast from conveyor 11 and projects beyond an end of machine frame 5 for removal of the ballast from machine 1.

The ballast aspirating device further comprises air filter arrangement 26 arranged between cyclone separator 24 and compressor 20 for filtering dust from the suction air through air filter 27. Worm conveyor 28 is arranged to receive the filtered dust from the air filter and to discharge the dust on conveyor 11 arranged below the air lock. The filtered dust is collected in a receptacle at the bottom of air filter arrangement 26 and is cyclically discharged from the receptacle onto conveyor 11 through discharge chute 29 while the machine stands still. The dust is then conveyed with the ballast by conveyors 11 and 12.

During the movement of machine 1 between operating sites, ballast excavating devices 9 are raised above track 3 and are pivoted into a position extending parallel to the longitudinal direction of machine frame 5 entirely within the machine frame, as shown in phantom lines 56 in FIG. 4, i.e. the ballast excavating devices are within profile 54 of the track and do not laterally project therefrom. To move the ballast excavating devices into their operating position, transverse displacement drives are actuated until the one ends of beams 31 are located above the respective ends of ties 51. Vertical adjustment drives 44 are then actuated to lower carrier frame 36. As soon as excavating chains 30 are in contact with the surface of ballast 7, rotating drives 50 are actuated to start revolving the endless excavating chains, which causes the chains to bite into the ballast and to excavate the same until beams 31 extend below the lower edges of ties 51. (It may be necessary, at the beginning, to dig a ditch manually into the ballast to receive the ballast excavating device at the end of the tie.) After ballast excavating devices 9 have assumed their position at a level under the track ties, beams 31 are pivoted about 90° in a horizontal plane by actuating pivoting drives 38 and compressor 20 is turned on to start the aspiration of the excavated ballast.

If desired, tilting drive 48 may be actuated to tilt beam 31 in a vertical plane extending perpendicularly to the longitudinal direction of machine frame 5 so that the subgrade exposed by the removal of ballast 7 by excavating chain 30 will be so inclined that any water in the track bed will flow towards the shoulders and will thus be removed. While the ballast bed is excavated and the ballast is aspirated, machine 1 advances continuously along track 3.

The terms "horizontal" and "vertical" are used throughout the specification and claims with respect to a situation in which machine 1 runs on a straight track extending in a horizontal plane.

If desired, the aspirated ballast could be conveyed to a screening device for cleaning the ballast, in which case the machine would be a continuously advancing ballast cleaning machine.

What is claimed is:

1. A mobile machine for aspirating ballast from a ballast bed supporting a track consisting of rails fastened to ties having opposite ends at shoulders of the ballast bed, which comprises (a) a machine frame extending in a longitudinal direction and supported by undercarriages running on the track, and mounted on the machine frame, (b) a ballast aspirating device comprising
  (1) a short suction inlet pipe defining a suction inlet port, and (c) a ballast excavating device vertically adjustable by drive means linking the ballast excavating device to the machine frame, the ballast excavating device comprising
  (1) a substantially horizontally extending beam having opposite ends,
  (2) a guide roller mounted on each beam end and
  (3) an endless ballast excavating chain trained over the guide rollers,
  (4) the beam being pivotal about a vertical axis at one of the beam ends and the vertical axis being arranged in an operating position laterally adjacent one of the tie ends at one of the ballast bed shoulders and the suction inlet port being vertically adjustable, (d) a carrier frame vertically spaced from the beam and extending transversely relative to the longitudinal direction of the machine frame,
  (1) the carrier frame being an elongated beam extending in a longitudinal direction transverse to the longitudinal direction of the machine frame, (e) a vertical carrier affixing the one beam end to the carrier frame, (f) a transverse guide affixed to the machine frame, the elongated beam being displaceably mounted on the transverse guide for displacement in said transverse direction, and (g) a longitudinal displacement drive connected to the elongated beam.

2. The mobile ballast aspirating machine of claim 1, wherein the suction inlet port is arranged in said operating position close to the guide roller at the ballast bed shoulder.

3. The mobile ballast aspirating machine of claim 1, wherein the beam has a minimum length of 2.60 meters.

4. The mobile ballast aspirating machine of claim 1, wherein the beam has a maximum length of 3.25 meters.

5. The mobile ballast aspirating machine of claim 1, further comprising a vertical guide post carrying the transverse guide, a vertical guide in the machine frame, the vertical guide receiving and guiding the vertical guide post, and a vertical adjustment drive connected to the vertical guide post for vertically adjusting the transverse guide relative to the machine frame.

6. The mobile ballast aspirating machine of claim 5, further comprising a pivot shaft supporting the transverse guide on the vertical guide post, the pivot shaft extending in the longitudinal direction of the machine frame and perpendicularly to the longitudinal direction of the elongated beam, and a tilting drive for tilting the transverse guide about the pivot shaft in a plane extending vertically relative to the longitudinal direction of the machine frame.

7. The mobile ballast aspirating machine of claim 1, comprising two of said ballast excavating devices spaced from each other in the longitudinal direction of the machine frame, the one pivotal beam ends of the ballast excavating devices being arranged opposite each other with respect to a vertical plane of symmetry extending in the longitudinal direction of the machine frame.

8. The mobile ballast aspirating machine of claim 1, further comprising an operator's cab mounted on the machine frame within view of the ballast excavating device, a track lifting device and a ballast tamping unit mounted on the machine frame rearwardly of the ballast excavating device in an operating direction of the machine, and a device for discharging ballast mounted on the machine frame between the track lifting device and the ballast excavating device.

9. A mobile machine for aspirating ballast from a ballast bed supporting a track consisting of rails fastened to ties having opposite ends at shoulders of the ballast bed, which comprises (a) a machine frame extending in a longitudinal direction and supported by undercarriages running on the track, and mounted on the machine frame, (b) a ballast aspirating device comprising
  (1) a short suction inlet pipe defining a suction inlet port, (c) a ballast excavating device vertically adjustable by drive means linking the ballast excavating device to the machine frame, the ballast excavating device comprising
  (1) a substantially horizontally extending beam having opposite ends,
  (2) a guide roller mounted on each beam end and
  (3) an endless ballast excavating chain trained over the guide rollers,
  (4) the beam being pivotal about a vertical axis at one of the beam ends and the vertical axis being arranged in an operating position laterally adjacent one of the tie ends at one of the ballast bed shoulders and the suction inlet port being vertically adjustable, and (d) a vertical baffle plate extending perpendicularly to the longitudinal direction of the beam, the suction inlet port being arranged between the baffle plate and the one tie end.

10. A mobile machine for aspirating ballast from a ballast bed supporting a track consisting of rails fastened to ties having opposite ends at shoulders of the ballast bed, which comprises:

(a) a machine frame extending in a longitudinal direction and supported by undercarriages running on the track, and mounted on the machine frame, (b) a ballast aspirating device comprising
  (1) a short suction inlet pipe defining a suction inlet port,
  (2) a compressor connected to the short suction inlet pipe, (3) a cyclone separator arranged between the inlet pipe and the compressor, and (4) an air lock at an outlet of the cyclone separator, (c) a conveyor arranged below the air lock of the cyclone separator for receiving and removing the ballast from the separator, and (d) a ballast excavating device vertically adjustable by drive means linking the ballast excavating device to the machine frame, the ballast excavating device comprising (1) a substantially horizontally extending beam having opposite ends, (2) a guide roller mounted on each beam end and (3) an endless ballast excavating chain trained over the guide rollers, (4) the beam being pivotal about a vertical axis at one of the beam ends and the vertical axis being arranged in an operating position laterally adjacent one of the tie ends at one of the ballast bed shoulders and the suction inlet port being vertically adjustable.

11. The mobile ballast aspirating machine of claim 10, further comprising a transfer conveyor arranged on the machine frame for receiving the conveyed ballast from the conveyor and projecting beyond an end of the machine frame.

12. The mobile ballast aspirating machine of claim 10, further comprising an air filter arranged between the cyclone separator and the compressor for filtering dust from the suction air.

13. The mobile ballast aspirating machine of claim 12, further comprising a worm conveyor arranged to receive the filtered dust from the air filter and to discharge the dust on the conveyor arranged below the air lock.

* * * * *